United States Patent [19]

Yang

[11] Patent Number: 4,897,033

[45] Date of Patent: Jan. 30, 1990

[54] LIGHTER WITH A CIGARETTE EXTINGUISHER

[75] Inventor: Bill Yang, Taipei, Taiwan

[73] Assignee: Cotron Corporation, Taipei, Taiwan

[21] Appl. No.: 306,702

[22] Filed: Feb. 6, 1989

[51] Int. Cl.[4] ..... F23Q 2/32; A24F 13/20; A24F 19/14

[52] U.S. Cl. ..... 431/253; 131/233; 131/235.1; 131/249; 131/250; 131/256

[58] Field of Search ..... 431/141, 253, 144, 145, 431/142, 277, 129, 344; 131/249, 256, 329, 237, 237.5, 248, 250, 233, 235.1, 238; 206/86

[56] References Cited

U.S. PATENT DOCUMENTS

| | | | |
|---|---|---|---|
| 1,459,077 | 6/1923 | Winans | 131/250 X |
| 2,585,071 | 2/1952 | Allen | 431/253 X |
| 2,777,569 | 1/1957 | Starke, Jr. | 431/253 X |
| 3,601,132 | 8/1971 | Etheridge | 131/256 |

FOREIGN PATENT DOCUMENTS

| | | | |
|---|---|---|---|
| 309022 | 9/1917 | Fed. Rep. of Germany | 131/249 |
| 696344 | 8/1940 | Fed. Rep. of Germany | 131/249 |
| 11454 | 5/1913 | United Kingdom | 131/249 |

*Primary Examiner*—Carl D. Price
*Attorney, Agent, or Firm*—Spencer & Frank

[57] ABSTRACT

A lighter provided with a cigarette extinguisher which is capable of cutting and extinguishing a burning head of a cigarette safely. The cigarette extinguisher comprises an upper cut element, a torsion spring, a tongue, a lower cut element and a pivot pin. The pivot pin pivotally connects the upper cut element and the lower cut element to facilitate the relative pivotal movement of the upper cut element and the lower cut element, the relative pivotal movement affects the cutting-off of a cigarette head which is inserted into the space between the upper cut element and the lower cut element.

3 Claims, 2 Drawing Sheets

LIGHTER WITH A CIGARETTE EXTINGUISHER

BACKGROUND OF THE INVENTION

The present invention relates to a lighter with a cigarette extinguisher, and particularly to a lighter provided with a cigarette extinguisher which is capable of cutting and extinguishing a burning head of a cigarette safely.

Conventional disposable gas lighters are cheap and small enough to carry easily; hence, they are very popular with cigarette smokers. However, it is sometimes necessary for a cigarette smoker to put out a burning cigarette immediately after lighting it due to sudden matters at hand. If the cigarette smoker throws the cigarette on the floor and treads upon it, the floor will often as not be blemished by the crushed cigarette. Furthermore, it is wasteful to throw a whole cigarette immediately after lighting it. In addition, if the cigarette smoker throws a still-burning cigarette into a garbage container, the burning cigarette would set fire to flammable materials within the garbage container. Also, if there is no ashtray available to the cigarette smoker and no convenient place to put a cigarette butt, the smoker must extinguish the cigarette and put it into his own pocket or back into the cigarette package, either way being dirty.

SUMMARY OF THE INVENTION

It is the object of this invention to provide a lighter with a cigarette extinguisher for extinguishing a burning cigarette safely.

It is another object of this invention to provide a lighter with a cigarette extinguisher for cutting off a burning cigarette head and cooling it down to make sure that it has been completely extinguished.

It is another object of this invention to provide a lighter with cigarette extinguisher for temporarily storing a cut-off cigarette head.

The above objects can be achieved by a lighter with a cigarette extinguisher which comprises a body having a fuel storage chamber; a fuel-ignition mechanism secured to the body; an upper cut element having a first end portion, a second end portion and a first blade formed on the first end portion; a lower cut element secured to the body, having a third end portion, a fourth end portion and a second blade formed on the third end portion; and a pivot pin for pivotally connecting the second end portion and the fourth end portion so as to facilitate the relative pivotal movement of the first blade and the second blade; the relative pivotal movement of the first blade and the second blade affects the cutting-off of a cigarette head being inserted into the space between the first blade and the second blade.

Other and further objects, features and advantages of this invention will appear more fully in the following description.

BRIEF DESCRIPTION OF THE DRAWINGS

This invention will be explained in more detail on the basis of an exemplary embodiment with reference to the drawings, in which.

DETAILED DESCRIPTION OF THE PREFERRED EMBODIMENT

Figure 1:
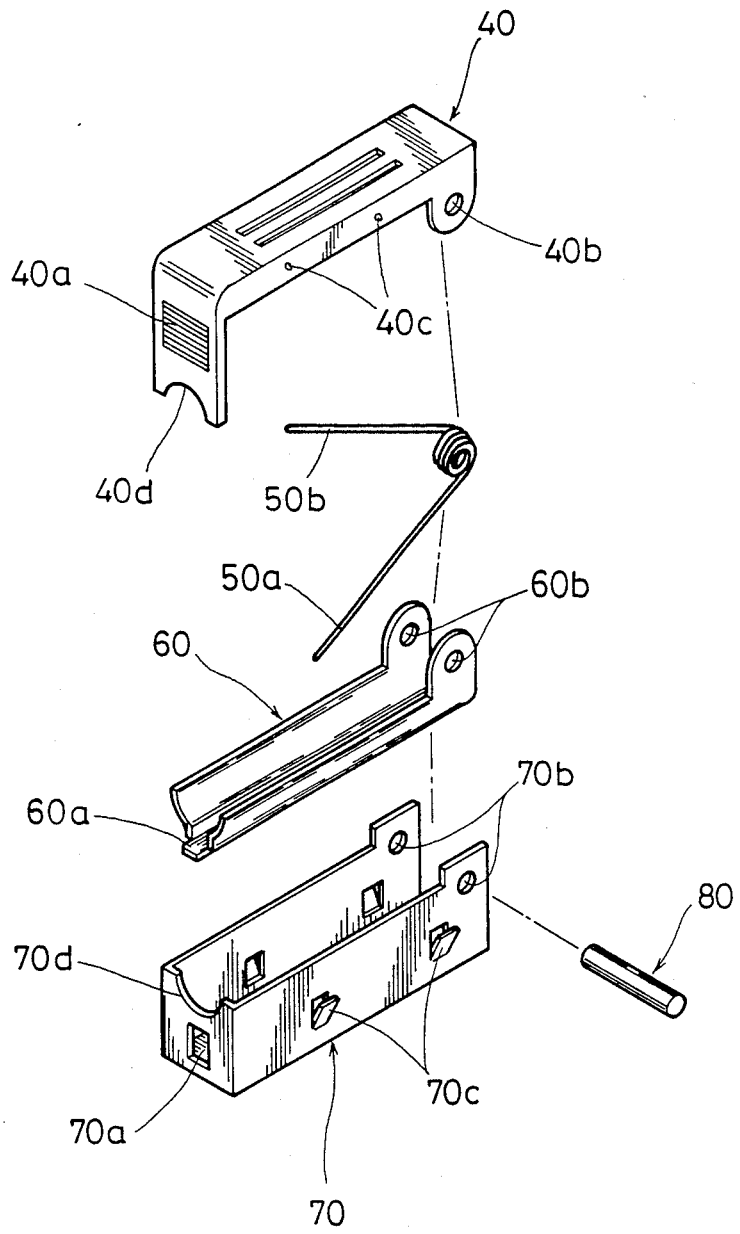
FIG. 1 is an enlarged exploded perspective view showing the construction of the cigarette extinguisher provided within the lighter according to this invention.
Figure 2:
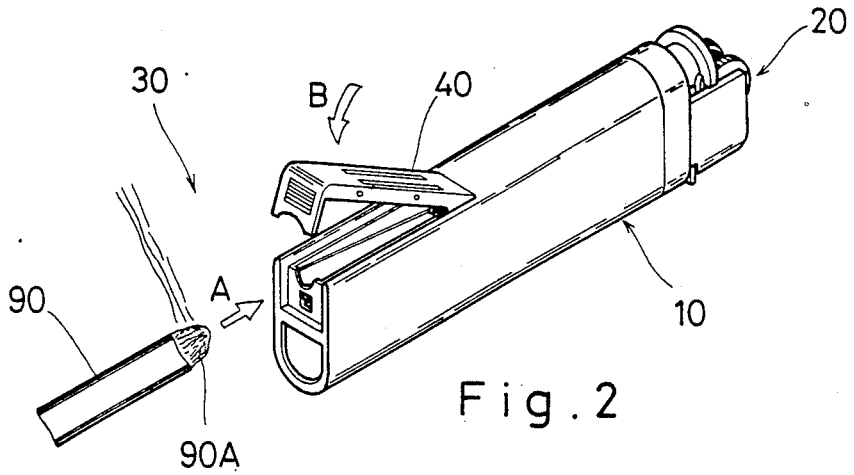
FIG. 2 is an outer perspective view of the lighter according to this invention, showing a burning cigarette about to be inserted into the cigarette extinguisher.
Figure 3:
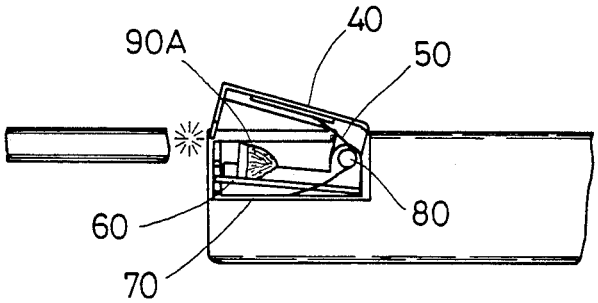
FIG. 3 is an elevational view, partially broken, showing that the burning cigarette head is cut off from the cigarette by the cigarette extinguisher of the lighter according to this invention.
Figure 4:
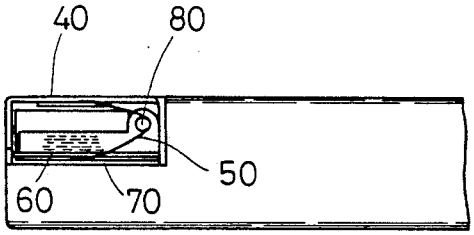
FIG. 4 is an elevational view, partially broken, showing that the cigarette head is being crushed by the cigarette extinguisher of the lighter according to this invention.
Figure 5:
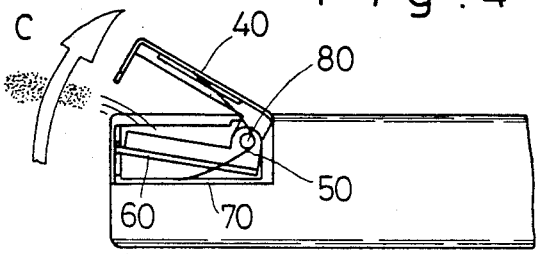
FIG. 5 is an elevational view, partially broken, showing that the crushed cigarette head is being expelled from the cigarette extinguisher of the lighter according to this invention.

As shown in FIG. 2, in addition to the fuel-ignition mechanism 20, a cigarette extinguisher 30 is provided on the left portion of the lighter 10 of this invention. The cigarette extinguisher 30 comprises an upper cut element 40, a torsion spring 50, a tongue 60, a lower cut element 70 and a pivot pin 80. The upper cut element 40 is L-shaped with two opposite side walls provided on its right portion, and two aligned pivot holes **40*b*, 40*b* are on two opposite side walls. Besides, two pairs of protrusions 40*c*, 40*c*, 40*c*, 40*c* are formed, respectively, on two opposite side walls of the middle portion of the upper cut element 40, and an antislipping portion 40*a* and a blade 40*d* are provided, respectively, on its left portion. The tongue 60 is a plate with semi-circular shaped cross-sections. Two aligned pivot holes 60*b*, 60*b* are provided on the two opposite side walls of the right portion of the tongue 60 and an end protrusion 60*a* is formed on its left end portion. The lower cut element 70 is shaped like an open-top rectangular container with two aligned pivot holes 70*b*, 70*b* on the opposite side walls of its right portion, and a rectangular slot 70*a* and a blade 70*d* are provided, respectively, on its left portion. In addition, two pairs of secure plates 70*c* are on two opposite side walls of the lower cut element 70, respectively, for securing itself to the body of the lighter 10. The pivot pin 80 pivotally connects the upper cut element 40, the torsion spring 50, the tongue 60 and the lower cut element 70 (see FIGS. 3, 4 and 5). In an assembled state, the two legs 50*a* and 50*b* of the torsion spring 50 are pressed against the lower cut element 70 and the upper cut element 40, respectively, to push them to pivotally move apart from each other; and the end protrusion 60*a* of the tongue 60 is loosely inserted into the slot 70*a* for limiting the upward and downward movements of the tongue 60. The protrusions 40*c*, on the side walls of the upper cut element 40 are frictionally engaged with the inside surfaces of the two opposite side walls of the lower cut element 70 to hold the two cut elements together temporarily against the urging force of the torsion spring 50**.

The following is the description of the operation of the lighter according to this invention. As shown in FIG. 2, a burning cigarette head **90*a* is going to be inserted into the opening between the blades 40*d* and 70*d* of the cigarette extinguisher 30. When the burning cigarette head 90*a* has been inserted into the cigarette extinguisher so that the whole head 90*a* is protruding beyond the blades 40*d* and 70*d*, the cigarette smoker presses down the upper cut element 40, in the direction of the arrow B, to bring the two blades 40*d* and 70*d* close to cut off the cigarette head 90*a* from the cigarette 90 (see FIG. 3). The cut-off cigarette head 90*a* will be enclosed within the upper cut element 40 and the tongue 60 of the cigarette extinguisher 30, and the remainder of the cigarette 90 can be refilled into the cigarette package or put into the pocket of the cigarette smoker. If the cigarette smoker continues pressing down the upper cut element 40, then the cigarette head 90***a* will be crushed by the upper cut element 40 and the tongue 60 of the cigarette extinguisher 30 (see FIG. 4), and the heat of the cigarette head 90*a* will be transferred to the upper cut element 40 and the tongue 60 which are generally made of metal, and the temperature of the cigarette head 90*a* will decrease. At this time, the protrusions 40*c*, of the upper cut element 40 will engage the upper cut element 40 and the lower cut element 70 to enclose the cigarette head 90*a* within the cigarette extinguisher 30, the cigarette smoker may put the lighter into his pocket and the ashes of the cigarette will not dirty it. After the cigarette head 90*a* has completely cooled down, the cigarette smoker may find a proper container (for example, an ashtray) to pour out the waste of the cigarette head into (see FIG. 5). To open the cigarette extinguisher 30, the cigarette smoker may grip the lighter and push upward the antislipping portion 40*a* of the upper cut element 40 in the direction of the arrow C with his thumb. The upper cut element 40 will be urged to move upward by the torsion spring 50 after the disengagement of the protrusions 40*c* and the side walls of the lower cut element 70. Due to the frictional forces existing between the side walls of the upper cut element 40 and the tongue 60 adjacent to the pivot pin 80, the tongue 60 will be caused to move upward during the upward movement of the upper cut element 40.

As described above, the lighter with cigarette extinguisher of this invention is capable of cutting off the cigarette head to avoid wasting a cigarette.

Furthermore, the lighter with cigarette extinguisher of this invention is capable of cooling down the cigarette head to avoid setting fire to flammable materials.

Also, the lighter with cigarette extinguisher of this invention is capable of storing the cigarette head temporarily within the cigarette extinguisher, so that the ashes will not dirty up the pockets or blemish floors.

Although the invention has been described in its preferred form with a certain degree of particularity, it is understood that the present disclosure of the preferred form may be somewhat changed, construction, combination and arrangement of parts may be referred to without departing from the spirit and the scope of the invention as hereinafter claims.

What is claimed is:

1. A lighter with a cigarette extinguisher, comprising:

a body having a fuel storage chamber;

fuel igniting means secured to said body;

first cutting means having a first end portion, a second end portion and a first blade formed on said first end portion;

second cutting means secured to said body, having a third end portion, a fourth end portion and a second blade formed on said third end portion;

pivoting means for pivotally connecting said second end portion and said fourth end portion so as to facilitate relative pivotal movement of said first blade and said second blade, said relative pivotal movement of said first blade and said second blade affecting cutting-off of a cigarette head inserted into a space between said first blade and said second blade;

biasing means, disposed between said first cutting means and said second cutting means, for biasing said two cutting means to move apart from each other; and a tongue disposed between said first cutting means and said second cutting means, for cooperating with said first cutting means to crush said cut-off cigarette head.

2. A lighter with a cigarette extinguisher as claimed in claim 1, further comprising:

holding means for temporarily holding said first cutting means and said second cutting means in an engaged state.

3. A lighter with a cigarette extinguisher as claimed in claim 2, wherein said first cutting means and said tongue are made of metal.

* * * * *